United States Patent [19]

Murray

[11] Patent Number: 4,856,273

[45] Date of Patent: Aug. 15, 1989

[54] SECONDARY OIL SYSTEM FOR GAS TURBINE ENGINE

[75] Inventor: Stephen G. Murray, Indianapolis, Ind.

[73] Assignee: General Motors Corporation, Detroit, Mich.

[21] Appl. No.: 222,470

[22] Filed: Jul. 21, 1988

[51] Int. Cl.[4] ..... F02C 7/06

[52] U.S. Cl. ..... 60/39.08; 184/6.2; 184/6.4; 184/6.11; 184/65; 384/473

[58] Field of Search ..... 60/39.08, 39.091, 39.83; 184/6.11, 6.4, 6.2, 65; 384/473

[56] References Cited

U.S. PATENT DOCUMENTS

| | | | |
|---|---|---|---|
| 3,147,821 | 9/1964 | Eggenberger | 184/65 |
| 3,779,345 | 12/1973 | Barnes et al. | 184/6.4 |
| 4,153,141 | 5/1979 | Methlie | 60/39.08 |
| 4,284,174 | 8/1981 | Salvana et al. | 60/39.08 |
| 4,373,421 | 2/1983 | Camboulives et al. | 60/39.08 |
| 4,390,082 | 6/1983 | Swearingen | 60/39.08 |
| 4,511,016 | 4/1985 | Döëll | 60/39.08 |
| 4,564,084 | 1/1986 | Heckel | 60/39.08 |
| 4,717,000 | 1/1988 | Waddington et al. | 184/61 |
| 4,741,155 | 1/1988 | McCarty | 60/39.02 |

*Primary Examiner*—Donald E. Stout
*Attorney, Agent, or Firm*—Saul Schwartz

[57] ABSTRACT

A secondary oil system for a flight propulsion gas turbine engine having a vertical flight mode and a horizontal flight mode. The secondary oil system includes an annular secondary oil tank in a bearing sump of the engine adjacent a bearing to be lubricated, an oil inlet from the primary oil system of the engine into the secondary oil tank for filling the tank with a fraction of the oil flow in the primary oil system, a discharge orifice at the bottom of the secondary oil tank in each of the vertical and horizontal flight modes so that a gravity induced secondary oil flow constituting a small fraction of the oil flow in the primary system continuously issues from the secondary oil tank, a first partition in the secondary oil tank dividing the latter into a holding chamber which retains a volume of oil when the engine is shut down in the vertical flight mode after a normal landing and a descent reservoir open to the discharge orifice, and a second partition in the descent reservoir forming a standpipe over the discharge orifice in the horizontal flight mode so that the descent reservoir always contains a minimum volume of oil when the engine transitions from the horizontal to the vertical flight mode. If primary oil flow stops, the oil in the holding chamber sustains horizontal flight for an initial secondary duration and the oil in the descent reservoir sustains vertical flight for a final secondary duration for controlled descent.

3 Claims, 4 Drawing Sheets

SECONDARY OIL SYSTEM FOR GAS TURBINE ENGINE

This invention was made in the course of work under a contract or subcontract of the U.S. Department of Defense.

FIELD OF THE INVENTION

This invention relates to secondary oil systems in flight propulsion gas turbine engines for lubricating rotating elements of the engines after primary lubrication stops.

BACKGROUND OF THE INVENTION

In an advanced aircraft being developed for military applications, a gas turbine engine pivotally mounted at the end of each wing of the aircraft drives a corresponding one of a pair propeller-like rotors. The engines have a vertical flight mode wherein the rotors effect vertical takeoffs and landings in helicopter-like fashion. Between takeoffs and landings, the engines have a horizontal flight mode wherein the rotors propel the aircraft in fixed wing fashion for maximum speed and maneuverability.

In commonly owned United U.S. patent application Ser. No. 222,994, filed concurrently with this patent application by Warren N. Holcomb to the assignee of this invention, and now allowed, a secondary oil system particularly suited for such flight propulsion gas turbine engines is described. The aforesaid secondary oil system includes an annular secondary oil tank in an internal sump of the engine from which a gravity induced secondary oil flow is continuously directed to a bearing in the sump. An inlet from the primary oil system of the engine to the secondary tank is at the top of the tank and a discharge from the tank is at the bottom thereof in both the horizontal and vertical flight modes. If primary oil flow stops, gravity induced secondary oil flow persists in both the horizontal and vertical flight modes until the secondary tank completely drains through the discharge. The duration of the secondary oil flow is calculated to permit the aircraft to fly horizontally to a landing area and then to land vertically. A new and improved secondary oil system according to this invention incorporates partitions in the secondary oil tank to assure a minimum secondary oil supply for vertical descent and to improve the gravity induced secondary oil flow.

SUMMARY OF THE INVENTION

This invention is a new and improved secondary oil system for a flight propulsion gas turbine engine having vertical and horizontal flight modes, the secondary oil system including a secondary oil tank attached to the engine for movement therewith between horizontal and vertical positions, an inlet from the primary oil system of the engine to the secondary tank whereby the latter is continuously supplied with a fraction of the primary oil flow, and a discharge orifice at the bottom of the secondary tank in each of the horizontal and vertical flight modes through which a gravity induced secondary oil flow is continuously conducted to a bearing in an internal sump of the engine. The secondary oil tank has a plurality of internal partitions which cooperate in defining a descent reservoir in the tank generally immediately adjacent the discharge orifice which reservoir normally forms a flow-through portion of the secondary oil system in the horizontal and vertical flight modes of the engine and which reservoir is always full when the engine transitions from the horizontal flight mode to the vertical flight mode so that if primary oil flow stops, a minimum supply of oil, concentrated at the discharge orifice, is available for secondary oil flow during descent in the vertical flight mode.

In the horizontal flight mode of the engine, a first partition which defines a side wall of the descent reservoir is horizontal and a second partition which defines a standpipe in the descent reservoir above the discharge orifice is vertical. The partition defining the standpipe maintains a minimum level of oil above the discharge orifice in the horizontal flight mode. When the engine transitions from the horizontal flight mode to the vertical flight mode, the first partition becomes vertical and confines the oil in the descent reservoir while the second partition becomes horizontal to permit complete drainage of the descent reservoir during aircraft descent in the vertical flight mode. In a preferred embodiment of the secondary oil system according to this invention, the secondary oil tank is an annular tank disposed in the bearing sump adjacent the bearing and the first partition defines a holding chamber in the secondary tank in the vertical flight mode which normally captures most of the oil in the secondary tank when the engine transitions to the vertical flight mode thereby to prevent the entire contents of the secondary tank from draining into the sump each time the engine is shut down after a normal flight.

DESCRIPTION OF PREFERRED EMBODIMENTS

Figure 1:
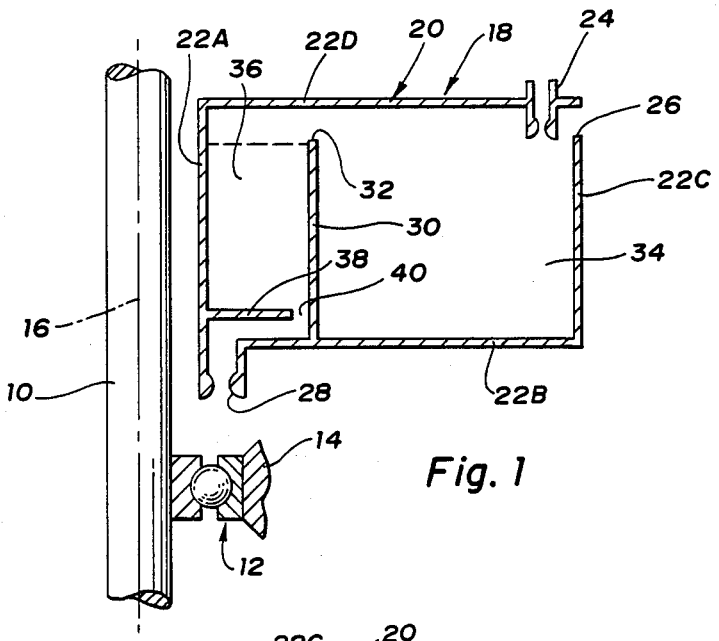
FIG. 1 is a schematic representation of a generic embodiment of the secondary oil system according to this invention illustrated in a position corresponding to the vertical flight mode of the engine.
Figure 2:
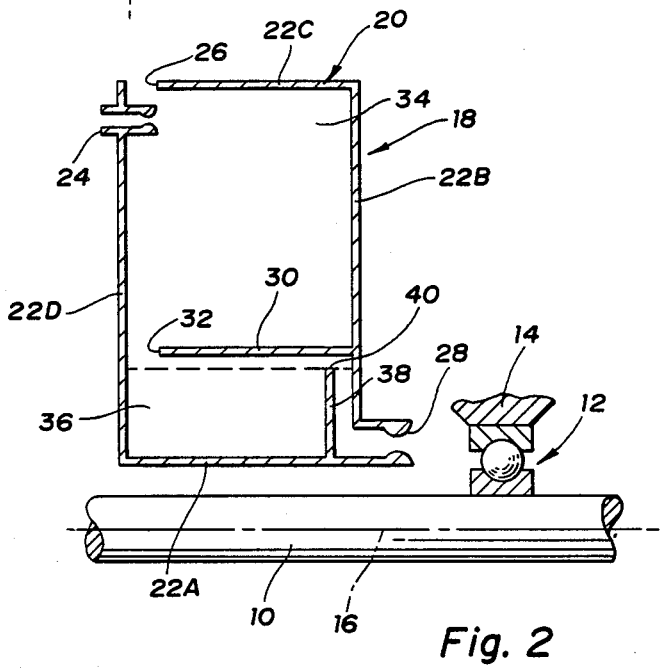
FIG. 2 is similar to FIG. 1 but showing the generic secondary oil system according to this invention in a position corresponding to the horizontal flight mode of the engine.

Referring to FIGS. 1 and 2 of the drawings, a shaft 10, representative of gas turbine engine rotor shafts generally, is supported by a bearing 12 on a fragmentarily illustrated casing 14 of a gas turbine engine for rotation about a main axis 16 of the engine. The engine has a vertical flight mode wherein the axis 16 is oriented vertically, FIG. 1, and a horizontal flight mode wherein the axis 16 is oriented horizontally, FIG. 2. In the vertical flight mode, the engine powers a propulsion rotor, not shown, above the bearing 12, FIG. 1, for helicopter-like vertical takeoffs and landings. In the interval between takeoff and landing, the engine transitions from the vertical flight mode to the horizontal flight mode wherein the propulsion rotor is to the left of the bearing 12, FIG. 2.

During normal engine operation, the bearing 12 is lubricated by a primary lubrication system of the engine, not shown, which provides lubrication and cooling for other elements of the engine as well. A schematically illustrated secondary oil system 18 according to this invention lubricates the bearing 12 if primary oil flow to the bearing stops while the gas turbine engine is operating.

The secondary oil system 18 includes a secondary tank 20 attached to the gas turbine engine for movement therewith between a first position, FIG. 1, corresponding to the vertical flight mode of the engine and a second position, FIG. 2, corresponding to the horizontal flight mode of the engine. The tank 20 has four walls 22A–D. An inlet orifice 24 is located in the wall 22D at a location on the latter at the top of the tank in each of the horizontal and vertical flight modes of the engine. The inlet orifice is connected to the primary oil system of the engine and conducts a fraction of the primary oil flow into the secondary tank 20 to fill the tank. An overflow and vent 26 is located generally at the intersection of the walls 22D and 22C near the inlet orifice 24. The overflow and vent is connected to the environment around the bearing 12 to equalize the pressures in the tank and around the bearing.

A discharge orifice 28 is located at the intersection of walls 22A and 22B at the bottom of the secondary tank in each of the horizontal and vertical flight modes of the engine. The discharge orifice is connected to a location near the bearing 12 and conducts a gravity induced secondary oil flow from the secondary tank to the bearing. The flow area of the discharge orifice is predetermined or calculated to limit the secondary oil flow to a small fraction of the primary oil flow. Under normal operating conditions, the supplemental effect of the secondary oil flow on the primary oil flow is minimal. If primary oil flow stops, the secondary oil flow provides enough lubrication to sustain the bearing 12 for a limited, secondary duration during which the aircraft may be landed in a controlled descent with the engine in the vertical flight mode.

The secondary tank 20 has a first partition 30 therein extending from the wall 22B toward the wall 22D with a gap 32 remaining between the partition and the wall 22D. In the first position of the secondary tank 20, FIG. 1, the partition 30 is vertical and divides the tank into a holding chamber 34 to the right of the partition and a descent reservoir 36 to the left of the partition. The gap 32 forms a passage across the first partition 30 between the holding chamber and the descent reservoir. The discharge orifice 28 opens only into the descent reservoir 36. In the second position of the secondary tank 20, FIG. 2, the first partition is horizontal and the holding chamber 34 is above the descent reservoir 36.

The secondary tank 20 has a second partition 38 in the descent reservoir 36 extending from the wall 22A toward the first partition 30. The second partition 38 is adjacent the discharge orifice 28 and a gap 40 remains between the second partition 38 and the first partition 30. In the first position of the secondary tank 20, FIG. 1, the second partition 38 is horizontal and defines a drain channel or passage to the discharge orifice between the second partition and the wall 22B. The drain channel is accessible to the remainder of the descent reservoir through the gap 40 which reservoir thus forms a passage between the gap 32 and the discharge orifice. In the second position of the secondary tank 20, FIG. 2, the second partition 38 is vertical and forms a standpipe in the reservoir chamber 36 above the discharge orifice 28.

The schematically illustrated secondary oil system according to this invention operates as follows. When the aircraft is on the ground, the gas turbine engine is in the vertical flight mode and the secondary tank 20 is in the first position, FIG. 1. During the initial phase of the engine start sequence, a primary oil flow is initiated in the primary oil system. Part of primary oil flow enters the secondary tank 20 through the inlet orifice 24 and commences to fill the holding chamber 34 and then the reservoir chamber 36 as oil spills over the top of first partition 30. As the reservoir chamber 36 fills, gravity induces the aforesaid secondary oil flow through the discharge orifice 28 to the bearing 12.

After takeoff in the vertical flight mode, the gas turbine engine transitions to the horizontal flight mode. The secondary tank 20 likewise transitions from the first position to the second position, FIG. 2. In the second position of the tank 20, the holding chamber 34 drains into the reservoir chamber 36 through the gap 32 and the reservoir chamber 36 drains through the discharge orifice 28 as long as the level of the oil in the reservoir chamber 36 exceeds the height of the standpipe-forming second partition 38. Under normal operating condition, oil inflow from the primary oil system through the inlet orifice 24 corresponds generally to the outflow through the discharge orifice 28 so that the secondary tank 20 is always substantially full of oil up to the level of the overflow and vent 26.

For a normal landing, the gas turbine engine and the secondary tank 20 transition, respectively, to the vertical flight mode and to the first position, FIG. 1. Oil inflow from the primary oil system corresponding to secondary oil flow through discharge orifice 28 prevents the oil level in the secondary tank from draining down, oil continuously spilling over the top of the first partition 30 from the holding chamber 34 into the reservoir chamber 36. When the gas turbine engine is shut down after landing, only the oil in the reservoir chamber 36 drains by gravity into the environment around the bearing, the remainder being captured in the holding chamber 34 in preparation for the next succeeding engine start-up.

If the primary oil flow stops in flight with the engine operating in the horizontal flight mode, secondary oil flow through the discharge orifice 28 persists. This initial secondary oil flow is sustained by the oil in the holding chamber 34 which gradually empties through the gaps 32 and 40. The volume of the holding chamber 34 above the first partition 30 is coordinated with the flow area of the discharge orifice 28 to sustain this initial secondary oil flow for an initial secondary duration of on the order of about ten minutes to accommodate fixed wing type horizontal flight to a landing zone.

When a landing zone is achieved, the engine and the secondary tank 20 transition, respectively, to the vertical flight mode and to the first position, FIG. 1. In the first position, the reservoir chamber 36 above the discharge orifice 28 is filled with at least a minimum volume of oil determined by the height of the second partition 38 above the wall 22A. The volume is calculated or predetermined to provide secondary oil flow for a final secondary duration corresponding to a controlled vertical descent. In addition, the reservoir chamber effectively concentrates the oil substantially right above the discharge orifice 28 to maximize the probability that the discharge orifice 28 will be continuously submerged in oil throughout the descent of the aircraft in the vertical flight mode.

Referring now to FIGS. 3–8 and describing a physical realization of the secondary oil system according to this invention, a fragmentarily illustrated gas turbine engine 42 includes a tubular rotor shaft 44 aligned on a rotor shaft axis 46 of the engine. The engine has a horizontal flight mode wherein the axis 46 is parallel to a horizontal coordinate axis 48 of the orientation diagram, FIG. 3, and a vertical flight mode wherein the axis 46 is parallel to a vertical coordinate axis 50 of the orientation diagram. In the horizontal flight mode, the front of the engine faces forward and to the left, FIG. 3, as indicated by the arrow on horizontal coordinate axis 48. In the vertical flight mode, the front of the engine faces up, FIG. 3, as indicated by the arrow on vertical coordinate axis 50.

The rotor shaft 44 cooperates with a generally annular housing 52 of the gas turbine engine in defining a bearing sump 54 of the engine. The housing 52 is a rigid internal appendage of the casing of the engine, not shown, and may be attached to the latter through a fragmentarily illustrated internal annular web 56. A bearing 58 is disposed between the housing 52 and the tubular rotor shaft 44 and cooperates with other bearings of the engine, not shown, in supporting the rotor shaft 44 on the casing of the engine for rotation about the axis 46. The bearing has an outer race 60 supported on the housing, an inner race 62 on the rotor shaft 44, and a plurality of bearing balls 64 between the races. The inner race is retained on the rotor shaft 44 by a nut 66 threaded on the shaft which captures the inner race 62, a pair of oil scavenge impellers 68, a spacer 70 and a seal runner 72 against a shoulder 74 of the shaft.

Toward the front of the engine, the bearing sump 54 is closed by an annular partition assembly 76 attached to the web 56. The partition assembly 76 carries a carbon seal 78 and a labyrinth seal 80 each of which cooperates with the seal runner 72 to define front seals for the sump 54. Toward the aft end of the engine, the sump 54 is closed by an annular partition assembly 82 attached to the housing 52. The partition assembly 82 carries a carbon seal 84 and a labyrinth seal 86 each of which cooperates with a seal runner 88 on the rotor shaft 44 to define aft or rear seals for the sump 54. To prevent internal contamination of the engine around the sump, a controlled pressure differential is maintained between the sump and its surrounding environment which differential assures gas leakage only into the sump.

An annular secondary tank 90 is disposed in the sump 54 adjacent the bearing 58. In cross section, the tank 90 has a U-shaped main body portion 92 the open end of which is closed by a wall 94. An annular pilot flange 96 of the main body portion 92 is closely received in a pilot diameter 98, FIG. 3, of the housing 52 whereby the secondary tank 90 is supported on the housing around the rotor shaft 44. The interface between the pilot flange 96 and the pilot diameter 98 is sealed by a seal ring in an appropriate groove in the pilot flange.

Figure 3:
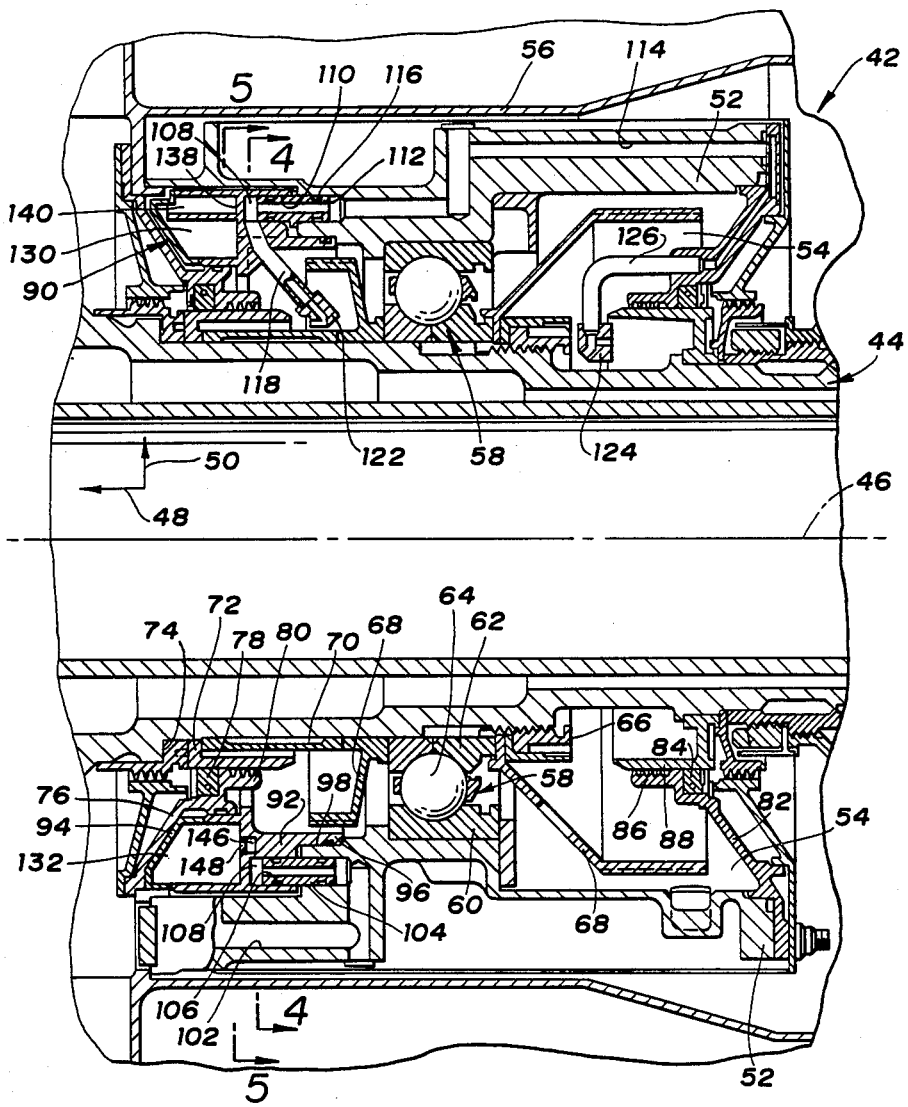
FIG. 3 is a fragmentary elevational view of a gas turbine engine in the horizontal flight mode thereof having a secondary oil system according to this invention and showing a bearing sump of the engine.
Figure 4:
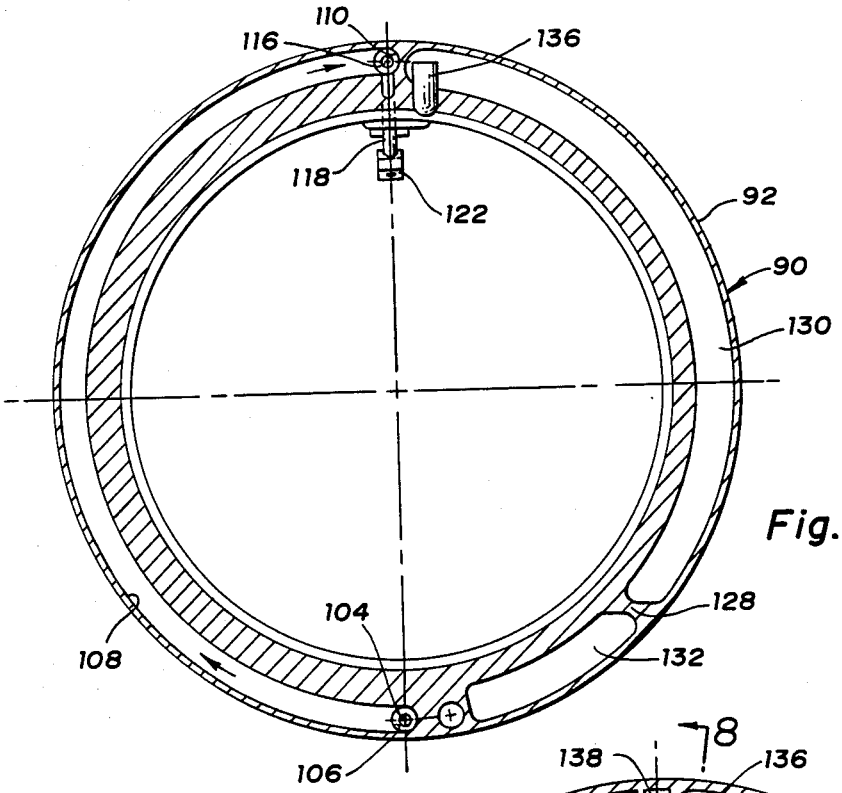
FIG. 4 is a fragmentary sectional view taken generally along the plane indicated by lines 4—4 in FIG. 3.
Figure 5:
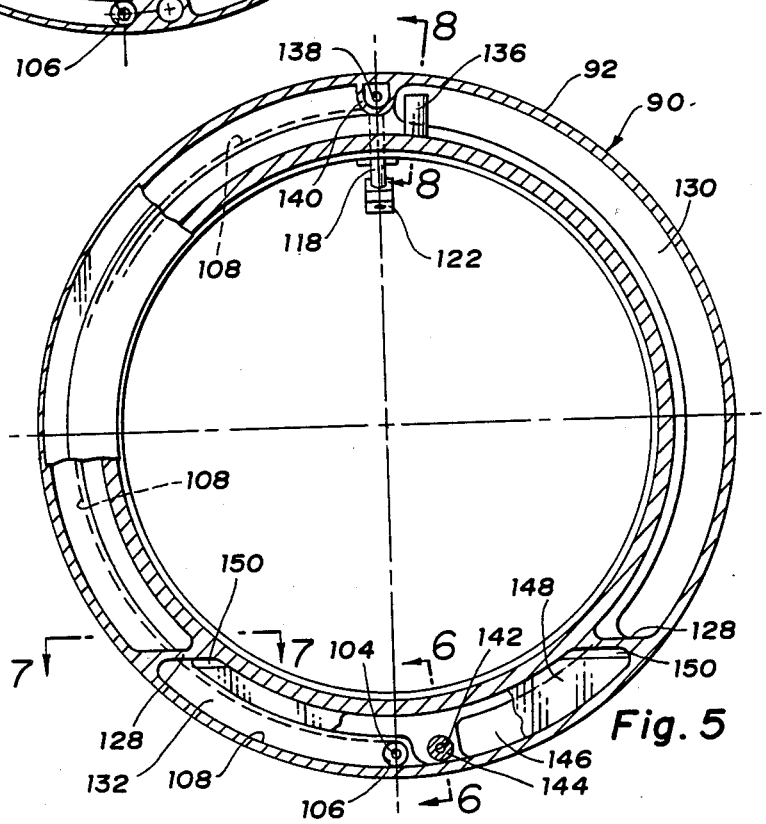
FIG. 5 is a fragmentary sectional view taken generally along the plane indicated by lines 5—5 in FIG. 3.

The primary oil system of the engine includes a first passage 102, FIG. 3, in the housing 52 and an inlet jumper tube 104 in a counterbored end of the first passage 102 and in an aligned bore 106, FIGS. 3–5, in the main body portion 92 of the secondary tank. The bore 106 communicates with an inlet channel or manifold 108 in the main body portion 92 extending from the bottom of the secondary tank, FIGS. 3–5, to the top. At the top of the secondary tank, the inlet manifold 108 intersects a bore 110 in the main body portion 92, FIGS. 3–4. The bore 110 is aligned with a counterbore 112 at the end of a a passage system 114 in the sump housing 52. A second jumper tube 116 is disposed in the bore 110 and in the counterbore 112 and connects the inlet manifold 108 to the passage system 114.

A tube 118, FIG. 3, on the main body portion 92 connects the inlet manifold 108 to a first primary nozzle 122. The nozzle 122 has an orifice for directing part of the primary oil flow as a jet of oil at the seal runner 72. A second primary nozzle 124 is connected to the passage system 114 through a tube 126. The second nozzle 124 has a plurality of orifices for directing part of the primary oil flow as jets of oil at the bearing 58 through grooves in the rotor shaft 44 and at the seal runner 88.

Figure 7:
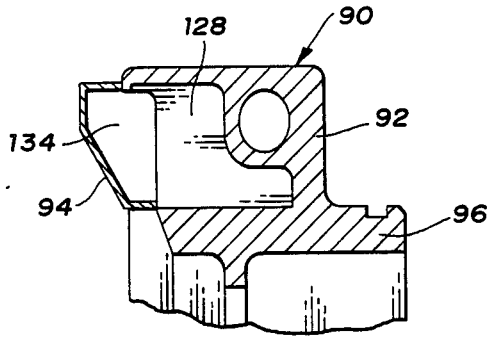
FIG. 7 is a sectional view taken generally along the plane indicated by lines 7—7 in FIG. 5.
Figure 8:
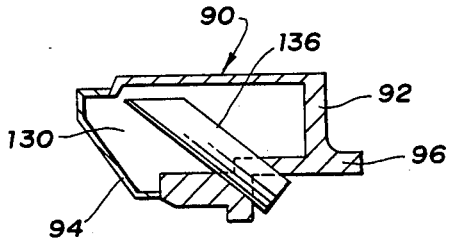
FIG. 8 is a sectional view taken generally along the plane indicated by lines 8—8 in FIG. 5.

As seen best in FIGS. 4, 5 and 7, the main body portion 92 of the secondary tank 90 has a pair of integral first partitions 128 extending part way toward the wall 94. The partitions 128 are vertical in the vertical flight mode of the gas turbine engine and horizontal in the horizontal flight mode of the gas turbine engine and cooperate in dividing the internal volume of the tank into an inverted or downward opening C-shaped holding chamber 130 above the partitions and an upright U-shaped descent reservoir 132 below the partitions. The holding chamber 130 communicates with the descent reservoir 132 through a pair of gaps 134, FIG. 7, between respective ones of the partitions 128 and the wall 94 of the secondary tank. A vent and overflow 136, FIGS. 4 and 8, has an open end near the top of the secondary tank in the vertical and horizontal flight modes of the gas turbine engine and maintains pressure equalization between the interior of the secondary tank and the bearing sump 54.

An inlet orifice 138, FIGS. 3 and 5, from the inlet manifold 108 to the holding chamber 130 opens into the bottom of a standpipe 140 in the holding chamber. The open end of the standpipe 140 is at the top of the secondary tank in each of the vertical and horizontal flight modes of the gas turbine engine. A discharge orifice 142 from the secondary tank is defined by a passage through a third jumper tube 144, FIGS. 5–6 located at the bottom of the reservoir tank in each of the vertical and horizontal flight modes of the gas turbine engine. The discharge orifice 142 communicates with an inverted arc-shaped relief 146 in the main body portion 92. The relief 146 extends in opposite directions from the discharge orifice 142 up to near the first partitions 128. The discharge orifice is connected by passages, not shown, in the sump housing 52 to the sump 54 near the bearing 58.

Figure 6:
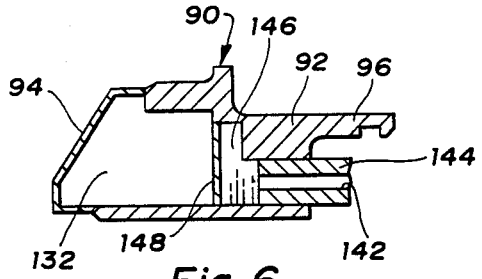
FIG. 6 is a sectional view taken generally along the plane indicated by lines 6—6 in FIG. 5.

As seen best in FIGS. 3, 5 and 6, an inverted arc-shaped second partition 148 is attached to the main body portion 92 within the descent reservoir 132. The second partition 148 covers the arc-shaped relief 146 up to just below the first partitions 128 whereat a pair of gaps 150, FIG. 5, are formed between the second partition 148 and the first partitions 128. The second partition 148 forms a standpipe over the discharge orifice 142 in the horizontal flight mode of the gas turbine engine separating the relief 146 from the remainder of the descent reservoir 132 except at the gaps 150. Accordingly, in the horizontal flight mode of the gas turbine engine, the minimum level of oil in the descent reservoir is the top of the second partition 148.

The secondary oil system constituted by the secondary tank 90, the inlet orifice 138, the discharge orifice 142 and the overflow and vent 136 functions as described with respect to the system illustrated schematically in FIGS. 1 and 2. Briefly, in the vertical flight mode of the gas turbine engine, inflow through the inlet orifice 138 fills the holding chamber 130 to the level of the standpipe 140 which is above the level of the first partitions 128. When the holding chamber 130 is full, oil spills through the gaps 134 and fills the descent reservoir 132. Because the second partition 148 is horizontal in the vertical flight mode of the engine, gravity induced secondary oil flow commences immediately through the gaps 150, the relief 146 in the main body portion 92, and through the discharge orifice 144. In the horizontal flight mode of the engine, the second partition 148 is vertical and prevents the oil level in the descent reservoir 132 from going below the gaps 150.

If primary oil flow stops in horizontal flight, gravity induced secondary oil flow is sustained by oil in the holding chamber 130 which drains to the discharge orifice 142 through the gaps 134 and 150. When the engine transitions to the vertical flight mode for controlled descent, the minimum volume of oil retained in the descent reservoir 132 is concentrated by the first partitions 128 above the discharge orifice and drains through the latter to sustain the bearing during descent.

The embodiments of the invention in which an exclusive property or privilege is claimed are defined as follows:

1. In a flight propulsion gas turbine engine having a horizontal flight mode and a vertical flight mode, a rotor shaft supported on a case of said engine by a bearing for rotation about a rotor axis of said engine oriented horizontally in said horizontal flight mode and vertically in said vertical flight mode, and a primary oil system for lubricating said bearing, a secondary oil system for said bearing comprising:

a secondary oil tank on said engine moveable therewith between a first position corresponding to said vertical flight mode and a second position corresponding to said horizontal flight mode, inlet means connecting said secondary oil tank to said primary oil system whereby said secondary oil tank is supplied with a fraction of the oil flow in said primary oil system, a discharge orifice in said secondary oil tank located at the bottom thereof in each of said first and said second positions of said secondary oil tank so that oil in said secondary oil tank is induced by gravity to flow out through said discharge orifice in each of said vertical and said horizontal flight modes of said gas turbine engine, said discharge orifice limiting said gravity induced oil outflow from said secondary oil tank to a secondary oil flow constituting a small fraction of the oil flow in said primary oil system in each of said first and said second positions of said secondary oil tank, first partition means in said secondary oil tank defining a descent reservoir chamber connected to said discharge orifice in each of said first and said second positions of said secondary oil tank, and second partition means in said secondary oil tank operative to maintain a predetermined minimum volume of oil in said descent reservoir tank in said second position of said secondary oil tank so that said predetermined minimum is available to sustain said secondary oil flow when said engine transitions from said horizontal to said vertical flight mode.

2. In a flight propulsion gas turbine engine having a horizontal flight mode and a vertical flight mode, a rotor shaft supported on a case of said engine by a bearing for rotation about a rotor axis of said engine oriented horizontally in said horizontal flight mode and vertically in said vertical flight mode, and a primary oil system for lubricating said bearing, a secondary oil system for said bearing comprising:

a secondary oil tank on said engine moveable therewith between a first position corresponding to said vertical flight mode and a second position corresponding to said horizontal flight mode, inlet means connecting said secondary oil tank to said primary oil system whereby said secondary oil tank is supplied with a fraction of the oil flow in said primary oil system, a discharge orifice in said secondary oil tank located at the bottom thereof in each of said first and said second positions of said secondary oil tank so that oil in said secondary oil tank is induced by gravity to flow out through said discharge orifice in each of said vertical and said horizontal flight modes of said gas turbine engine, said discharge orifice limiting said gravity induced oil outflow from said secondary oil tank to a secondary oil flow constituting a small fraction of the oil flow in said primary oil system in each of said first and said second positions of said secondary oil tank, a first partition in said secondary oil tank extending vertically in said first position of said secondary oil tank and forming therein a descent reservoir on the side of said first partition facing said discharge orifice and a holding chamber on the opposite side thereof, first passage means across said first partition between said holding chamber and said descent reservoir at a predetermined height above a first side of said secondary oil tank forming the bottom thereof in said first position of said secondary oil tank so that oil in said holding chamber drains through said first passage means into said descent reservoir in said second position of said secondary oil tank and so that a portion of the volume of oil in said secondary oil tank is captured and retained in said holding chamber up to the height of said first passage means above said first side when said secondary oil tank moves with said engine from said second position of said secondary oil tank to said first position thereof, a second partition in said descent reservoir of said secondary oil tank extending vertically in said second position of said secondary oil tank and separating said first passage means from said discharge orifice, and second passage means across said second partition at a predetermined height above a second side of said secondary oil tank forming the bottom thereof in said second position of said secondary oil tank so that all of the oil in said reservoir chamber drains through said discharge orifice in said first position of said secondary oil tank and so that the minimum level of oil in said reservoir chamber in said second position of said secondary oil tank equals said predetermined height of said second passage means above said second side.

3. The secondary oil system recited in claim 2 wherein said secondary oil tank is an annular tank disposed in a sump of said gas turbine engine adjacent said bearing.

* * * * *